United States Patent [19]

Torgerson

[11] 4,086,482

[45] Apr. 25, 1978

[54] NONCONDUCTIVE LIGHT GUARD

[75] Inventor: Duane E. Torgerson, Oswego, Ill.

[73] Assignee: Belden Corporation, Geneva, Ill.

[21] Appl. No.: 726,992

[22] Filed: Sep. 27, 1976

[51] Int. Cl.[2] ..... F21V 15/00; F21V 21/00

[52] U.S. Cl. ..... 362/376; 362/396

[58] Field of Search ..... 240/102 R, 102 B, 54 R, 240/54 A

[56] References Cited

U.S. PATENT DOCUMENTS

| | | | |
|---|---|---|---|
| 3,826,912 | 7/1974 | Pomroy | 240/102 R |
| 3,935,560 | 1/1976 | Dorn | 240/54 A X |

*Primary Examiner*—John Gonzales

*Attorney, Agent, or Firm*—Fitch, Even, Tabin & Luedeka

[57] ABSTRACT

A light guard is disclosed which is made from an electrically nonconductive high temperature resistant rigid plastic material and includes a shield member and a protective cage member. The cage member is releasably latched to the shield member in supported relation thereon to facilitate complete detachment of the cage member for access to a light bulb disposed within the light guard, the shield member having provision for connection to a light bulb socket holder and including hook means for selective hanging of the guard.

11 Claims, 4 Drawing Figures

98
12
10
26
38
78b
78
22
78a
78c
30
72
36
36a
32
70
52
28
76c
76
76a
20
76b
40a
2Д
3Д
3Дa
Д6
Д6a
50
16
ДД
Д8
Д8a
1Д
60
82a
82
80a
58a
80
88
82b
56a
56b
56c
80b
58b
6Д
62

88
20
80a
80
90
76
38
96
76a
76b
58a 20
40b
12
88
82
90
9Д
72
70
76
76a
78a
78
68
92
88
62
80
56c
80b
1Д
56a
56b 98
10

60
38
12
2Д
Д
Д
40a
80a
58a
76b
80
20
3.
3.
76
88
56a
76c
80b
40b
56b
58b
6Д
68
70
28
62
32
ДД
16
50
52

NONCONDUCTIVE LIGHT GUARD

The present invention relates generally to a guard for a light bulb such as an incandescent light bulb, and more particularly to a novel light guard made of an electrically nonconductive high temperature resistant rigid plastic material and which includes a shield member to which a protective cage is releasably secured by latch means facilitating snap-on attachment of the cage to the shield member while facilitating complete detachment of the cage from the shield.

It is known to employ a light guard with extension type lights, frequently termed trouble lights, so as to protect the light bulb mounted in a bulb socket to which the light guard is secured. Such light guards are employed with incandescent light bulbs and generally include a reflector or shield portion and a cage portion. The shield portion conventionally partially encircles the light bulb and provides a reflective surface while also providing a shield by which the user may shield the light from his eyes when the light is disposed between the user and an object being illuminated. The shield also serves to control the arcuate extent of light emitted from the light bulb when the light guard is employed for service lights mounted over doors and the like.

Light guards of the type with which the present invention is concerned have generally been manufactured from metal components, with the cage being hingedly connected to the reflector or shield portion such that the cage can be opened relative to the reflector for installation or replacement of a light bulb. While light guards made of metal can withstand substantial heat created by the light bulbs, they are considered a safety hazard due to their electrical conductivity and the resulting possibility of electrical shocks or burns to the user.

To overcome the safety hazards of metallic light guards, electrically nonconductive materials such as plastic have recently been employed in manufacturing light guards. The known plastic light guards form the cage or grid integral with the protective shield or reflector portion through a flexible hinge flange connection which facilitates relative movement between the cage and shield portions as when opening and closing the cage. A necessary requisite of such plastic light guards wherein the cage is integrally hingedly connected to the reflector or shield portion is that the plastic material must be flexible. Known plastic materials which provide the necessary flexibility for these light guards have relatively low melting temperatures which restricts their usage to light bulbs of 75 watts or smaller. For light bulbs of higher wattage, the light guards must be increased in size to provide suitable distance between the light bulb and the guard elements, with the result that manufacturing and material costs are substantially increased.

The present invention overcomes the disadvantages existent in prior light guards by providing a light guard made of an electrically nonconductive rigid plastic material capable of withstanding greater temperatures than the known light guards, where by the light guard may be made substantially the same size as a conventional metallic light guard even though used with a 100 watt light bulb. The light guard of the present invention may be used with an extension trouble light, a building exit or service light, or other installation requiring a light guard, and provides a cage portion which is completely detachable from a protective shield or reflector portion through a snap-on connection which eliminates the need for a hinge and its attendant requirement for a flexible plastic having a relatively low melting temperature. By eliminating the need for a hinge, a more rigid plastic may be employed for the snap-on cage and associated shield member which results in greater strength and a higher melting temperature for the light guard than obtainable with flexible plastic material as has heretofore been employed.

Accordingly, one of the primary objects of the present invention is to provide a light guard made from an electrically nonconductive rigid plastic material wherein a cage member is releasably secured to a shield or reflector member through snap-on latch means which facilitates complete removal of the cage from the shield or reflector member and allows the use of a rigid plastic material for the cage and shield to impart greater strength and higher temperature resistance to the light guard.

The various features and advantages of the invention will become apparent from the following detailed description of the invention when taken in conjunction with the accompanying drawing wherein like reference numerals designate like elements throughout the several views, and wherein.

Figure 1:
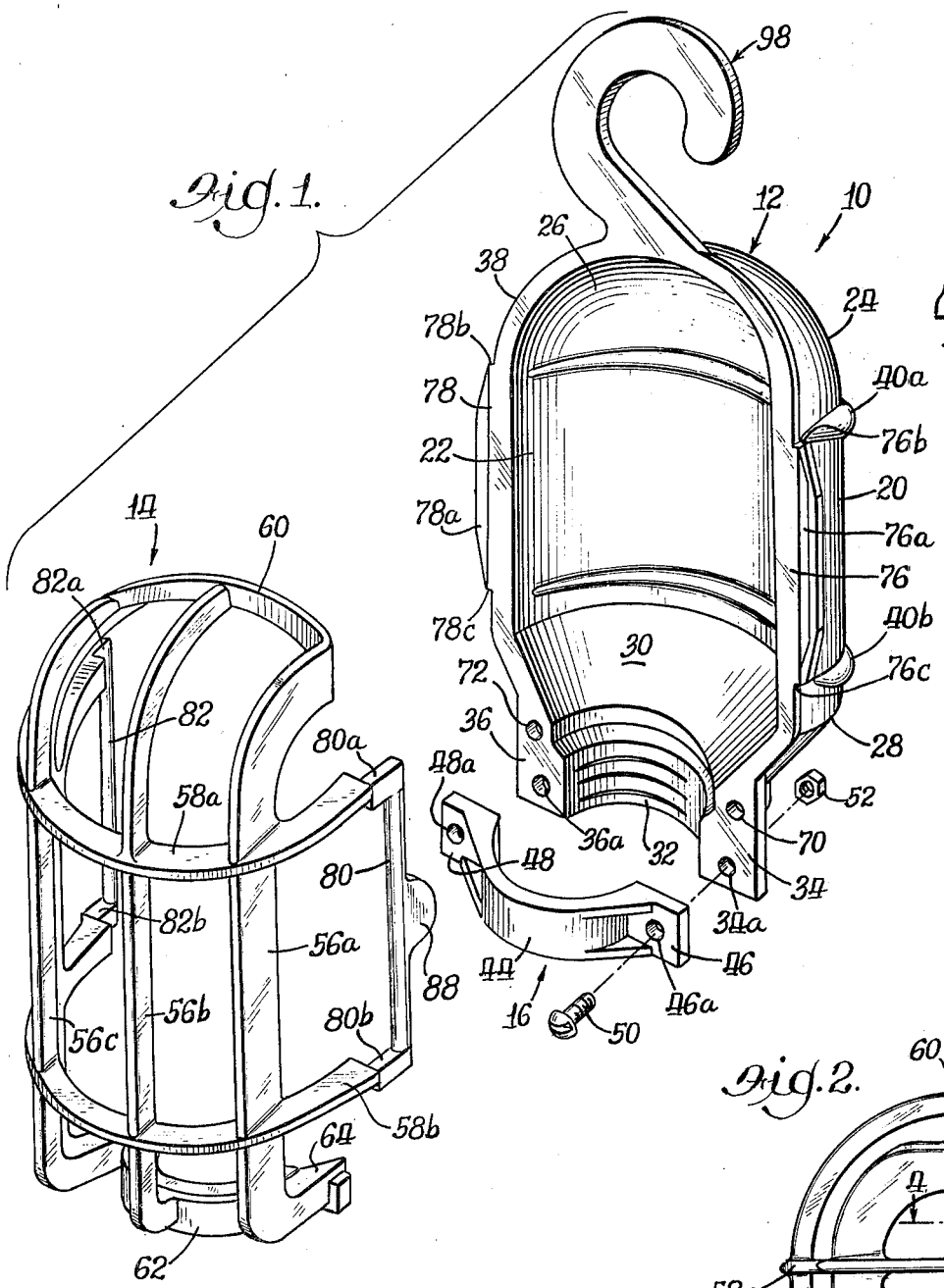
FIG. 1 is an exploded perspective view of a light guard constructed in accordance with the present invention.
Figure 2:
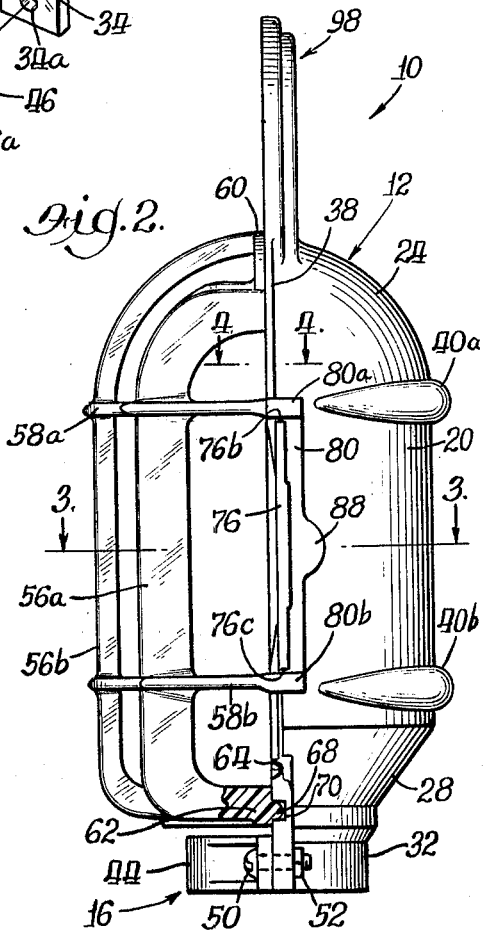
FIG. 2 is a side elevational view of the light guard of FIG. 1, portions being broken away for clarity.

Referring now to the drawing, and in particular to FIGS. 1 and 2, a light guard constructed in accordance with the present invention is indicated generally at 10. The light guard 10 includes a shield or reflector member, indicated generally at 12, a cage or grid member, indicated generally at 14, and clamping means, indicated generally at 16, for securing the light guard 10 to a lamp socket holder (not shown). The lamp socket holder is adapted to retain a lamp socket into which a conventional incandescent light bulb may be threadably secured in a known manner. The lamp socket holder may comprise a conventional socket-handle assembly as used with trouble lights or extension cord assemblies, or may comprise a lamp socket holder as conventionally mounted adjacent a door opening to provide a service or night light.

As will become more apparent hereinbelow, the cage member 14 is normally releasably secured to the shield member 12 through a snap-action connection therewith so that the cage member defines with the shield member a light bulb receiving cavity therebetween, the cage being completely detachable from the shield member independently of the clamping means 16. The shield member 12, cage 14 and detachable portion of the clamping means 16 are preferably made of an electrically nonconductive relatively rigid plastic material which provides the desired strength characteristics for the various elements of the light guard, provides the desired safety from electrical shock, and facilitates use of the light guard with 100 watt incandescent light bulbs in close proximity to the elements of the light guard without undergoing heat deformation. A 100 watt incandescent bulb reaches a surface temperature of approximately 390° F. so that the ability of the various components of the light guard 10 to withstand heat while in relatively close proximity to the light bulb is an important feature of the invention.

By "relatively rigid" is meant a plastic material and construction which is substantially more rigid than plastic light guard constructions made of flexible plastic such as required in manufacturing light guards of known design wherein the cage portions are hingedly connected to the shield or reflector portions through integral hinge connections, the reflector and cage being made in an integrally connected molded construction. As will become more apparent hereinbelow, while the cage 14 is made of a relatively rigid plastic material, some flexing is accommodated during snap-action attachment and detachment of the cage onto and from the shield or reflector member 12.

The shield member 12, which may alternatively be termed the lamp housing, includes a generally semi-cylindrical body 20 which has a semi-cylindrical concave interior surface 22. The semi-cylindrical body 20 terminates at its upper end, as considered in FIGS. 1 and 2, in a semi-domed portion 24 having a similarly shaped concave interior surface 26 contiguous to the interior concave surface 22. The semi-cylindrical body 20 terminates at its lower end in a semi-frustoconical shaped portion 28 having a similarly shaped concave interior surface 30. The lower semi-frustoconical portion 28 of the shield member 12 terminates at its lower end in a semi-cylindrical wall or band 32 which forms a portion of the clamping means 16 for securing the light guard to a portable hand-holdable light socket holder or to a light socket holder disposed in fixed position adjacent a door or the like to provide a service light. The semi-cylindrical wall 32 has coplanar mounting flanges 34 and 36 formed at its lateral edges. The outer coplanar surfaces of the mounting flanges 34 and 36 are coplanar with a flange 38 disposed peripherally of the marginal edges of the semi-cylindrical portion 20, the semi-domed portion 24 and the semi-frustoconical portion 28 of the shield member 12. Preferably, the shield member 12 is formed by conventional plastic molding techniques and has a pair of parallel longitudinally spaced ribs **40*a* and 40*b* formed in the semi-cylindrical wall 20** to add strength to the shield member and enhance the resistance of the shield member to breakage.

The coplanar flanges 34 and 36 provide mounting surfaces for a semi-cylindrical shaped clamping band 44 which has a pair of coplanar flanges 46 and 48 adapted to abut the flanges 34 and 36, respectively, so that the clamping band 44 cooperates with the wall or band 32 to define a substantially cylindrical recess therebetween of a size sufficient to facilitate mounting of the light guard to a light bulb socket holder in a known manner. The flanges 34, 36, 46 and 48 have openings **34*a*, 36*a*, 46*a* and 48*a*, respectively, adapted for axial alignment to receive mounting screws 50 and associated nuts 52 for retaining the clamping band 44 in cooperating relation with the clamping band 32. It will be understood that screws could be employed in lieu of the bolts 50 for self-tapping within the plastic flanges 34 and 36, thus eliminating the nuts 52**.

With the shield member 12 and clamping means 16 thus far described, it can be seen that the shield member 12 may be mounted on a light socket holder (not shown), such as on a hand-held trouble light, through the clamping means 16 independently of the cage 14. The shield member 12 serves to partially enclose the light bulb and protect one side thereof in addition to facilitating holding of the light bulb between one's eyes and an object being illuminated so that the light does not shine directly in the user's eyes. The interior concave surfaces 22, 26 and 30 serve to reflect light from the bulb toward the object or area being illuminated.

To protect the exposed portion of a light bulb when supported within the shield member 12 by the clamping means 16, the cage 14 is attached to the shield member after inserting the light bulb within the socket disposed within the clamping means 16. The cage member 14 includes a plurality of longitudinally extending parallel spaced ribs **56*a*, 56*b* and 56*c* which are maintained in parallel spaced relation by transverse longitudinally spaced semi-circular ribs 58*a* and 58*b*. The longitudinally extending ribs 56*a–c* have arcuate upper ends which terminate in and are formed integral with a planar arcuate flange 60 adapted to engage the upper end of the peripheral flange 38 on the shield member 12 when the cage 14** is attached to the shield member, as will be described more fully below.

The lower ends of the longitudinal ribs **56*a–c* are also arcuately shaped and are formed integral with a semi-cylindrical shaped rib 62 having a radius slightly larger than the radius of the clamping band 44 to accommodate a light bulb. The lower rib 62 lies in a plane perpendicular to the longitudinal axis of the cage 14 and has end surfaces, one of which is indicated at 64 in FIG. 1, coplanar with the forward contact surface of the upper arcuate flange 60 so that the end surfaces 64 engage the peripheral flange 38 on the shield member 12 proximate the mounting flanges 34 and 36 thereon. To assist in maintaining the cage 14 in fixed relation on the peripheral mounting flange 38 of the shield member 12, locating projections or detents in the form of a pair of nibs, one of which is indicated at 68 in FIG. 2, are formed on the end surfaces 64 and are adapted to be received within suitable recesses 70 and 72 formed in the flange 38 spaced upwardly from the holes 34*a* and 36*a***.

As noted, the cage 14 is adapted to be releasably attached to the shield or reflector member 12 through a snap-action connection. To this end, the shield member 12 has a pair of laterally outwardly extending retainer flanges 76 and 78 integral and coplanar with the flange 38 on the shield member. The flanges 76 and 78 have inclined ramp surfaces **76*a* and 78*a*, respectively, and are adapted for mutual cooperation with a pair of latching rods 80 and 82 each of which is formed integral with and extends between corresponding ends of the transverse ribs 58*a* and 58*b*. The latching rods 80 and 82 extend longitudinally of the cage 14 and their axes lie in a common plane parallel to and spaced forwardly from the plane of the contact surface on the arcuate flange 60 and the end surfaces 64 on the transverse rib 62. The latching rods 80 and 82 are cylindrical and are spaced laterally a distance substantially equal to the distance between the inclined ramp surfaces 76*a* and 78*a*, considered transversely of the shield member 12. The retaining flanges 76 and 78 on the shield member 12 and the latching rods 80 and 82 on the cage 14 define mutually cooperable laterally disposed latch means for releasably securing the shield and cage members in attached relation to each other. It will be appreciated that while the preferred embodiment of the light guard 10 has the retaining flanges 76 and 78 formed on the shield member 12 and the latching rods 80 and 82 formed on the cage 14**, the retaining flanges could be formed on the cage with the latching rods formed on the shield member.

Figure 4:
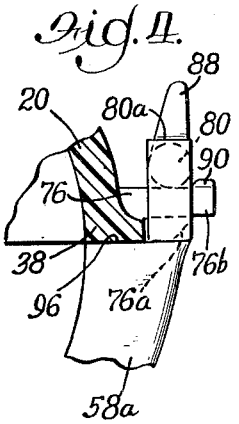
FIG. 4 is an enlarged partial transverse sectional view taken substantially along the line 4–4 of FIG. 2.
Figure 3:
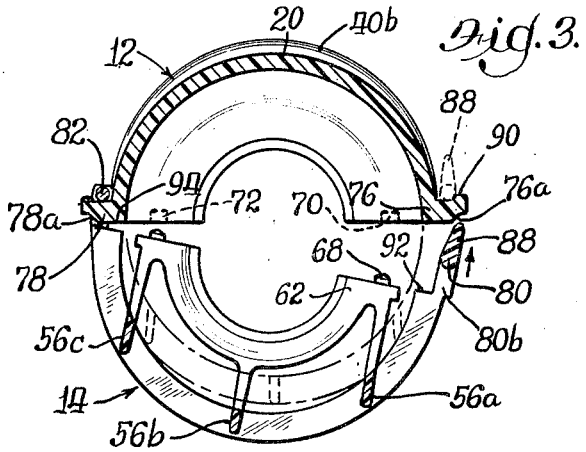
FIG. 3 is a transverse sectional view taken substantially along the line 3—3 of FIG. 2 but showing the cage as it is being attached to the shield member.

With reference to FIG. 3, one manner of attaching the cage 14 to the shield member 12 is illustrated wherein one latching rod, such as 82, is first placed rearwardly of the retainer flange 78 and the latching rod 80 is moved to a position toward the retainer flange 76 and associated ramp surface 76*a*. To insure proper alignment of the cage 14 with the shield member 12 during attachment, the lateral flanges 76 and 78 on the shield member are provided with end surfaces 76*b*, 76*c* and 78*b*, 78*c*, respectively, which serve to receive thereover outer end portions 80*a*, 80*b* and 82*a*, 82*b* of the transverse ribs 58*a* and 58*b* to which the latching rods 80 and 82 are secured so as to locate the cage relative to the shield member. The end portions 80*a*, 80*b* and 82*a*, 82*b* define stop surfaces spaced so as to cooperate with the end surfaces 76*b*, 76*c* and 78*b*, 78*c*, respectively, on said retaining flanges 76 and 78 to limit relative longitudinal movement between the shield and cage members. In accordance with the illustrated embodiment, a thumb release tab 88 is provided on at least one of the latch rods 80 and 82, it being shown on the latch rod 80 in the embodiment of FIG. 1. The release tab 88 is formed midlength of the latching rod 80 and serves to engage the ramp surface 76*a* and assist in biasing the latching rod 80 outwardly around the outer edge of the retaining flange 76 whereafter the latch rod 80 snaps rearwardly of the flange 76 as shown in phantom in FIG. 3. The thumb release tab 88 also facilitates detachment of the cage 14 from the shield member 12 by engaging the release tab with one's thumb and biasing the latch rod 88 around and forwardly of the retaining flange 76. The retaining flanges 76 and 78 preferably have rearwardly projecting longitudinal ribs 90 formed integral thereon to assist in retaining the latching rods 80 and 82 in mounted relation on the flanges 76 and 78. The transverse ribs 58*a* and 58*b* have stop surfaces, such as indicated at 92 and 94 on the rib 58*b* in FIG. 3 and at 96 on the rib 58*a* in FIG. 4, which serve to engage the flange 38 when the cage 14 is mounted on the shield member 12.

To facilitate hanging of the light guard 10 when secured on a trouble light or the like, as in hanging the light guard adjacent a work area, a hook, indicated generally at 98, may be formed on the shield member 12 adjacent the upper end thereof. While the hook 98 is illustrated as being formed integral with the shield member, it will be understood that the hook may be separable and secured to the shield member through a swivel hook connection as is known. The hook 98 is not an essential feature of the light guard 10 and may, if desired, be eliminated completely.

The shield member 12 and cage 14, and preferably also the clamping ring 44, are made of an electrically nonconducting relatively rigid plastic capable of withstanding the heat, i.e., approximately 390° F., produced by a 100 watt incandescent bulb. Thus, the light guard may be made of a size which rather closely encloses a conventional size 100 watt incandescent light bulb. To this end, the shield member 12 and cage 14 are preferably formed of a molded thermoset or thermoplastic polyester such as VALOX 420 or 420 SEO presently available from General Electric Company. The plastic material from which the cage 14 is preferably made may be reinforced with fiberglass, thus forming a glass reinforced thermoplastic polyester material. By forming the cage 14 and shield 12 for snap-on attachment of the cage to the shield member in accordance with the present invention, the need for a relatively flexible plastic material to form the shield integral with the cage through a hinge connection as has heretofore been required in the known plastic light guards is eliminated and a substantially higher melting temperature plastic material is used.

Thus, in accordance with the present invention, a light guard has been provided which is capable of withstanding the heat of higher wattage light bulbs than has heretofore been safely obtainable, while in addition providing for complete detachment of the protective cage from the light shield and reflector to provide greater access for replacement of the light bulb.

It will be understood that while a preferred embodiment of the present invention has been illustrated and described, changes and modifications may be made therein without departing from the invention in its broader aspects. Various features of the invention are defined in the following claims.

What is claimed is:

1. A light guard comprising a shield member having a concave interior surface, a cage member separate from said shield member but cooperable therewith to define a light bulb receiving chamber therebetween, one of said shield and cage members having substantially identically shaped lateral edges each of which has a retaining flange formed thereon, the other of said shield and cage members defining lateral edges each of which has latching rod means formed thereon adapted for lateral spreading therebetween sufficiently to facilitate snap-action attachment to said retaining flanges for releasably securing said shield and cage members in attached relation to define said bulb receiving chamber, and means for releasably attaching at least one of said shield and cage members to a light socket holder independent of the other of said shield and cage members so that said shield and cage members may be attached to and detached from each other independently of said light socket holder attaching means.

2. A light guard as defined in claim 1 wherein said shield and cage members are made of a rigid plastic material.

3. A light guard as defined in claim 2 wherein said rigid plastic material comprises a thermoplastic polyester.

4. A light guard comprising a shield member having a concave interior surface, a cage member cooperable with said shield member to define a light bulb receiving chamber therebetween, said shield member defining a pair of substantially parallel lateral edges each of which has a retaining flange formed thereon, said cage having a pair of substantially parallel laterally spaced latching rods cooperable with said retaining flanges to releasably attach said cage member to said shield member to define said bulb receiving chamber, said cage member having sufficient flexibility to facilitate lateral spreading of said latch rods during attachment of said cage member to said shield member, said latch rods undergoing a snap-action movement during positioning in retained relation with said retaining flanges, and means for releasably attaching at least one of said shield and cage members to a light socket holder independent of the other of said shield and cage members so that said shield and cage members may be attached to and detached from each other independently of said light socket holder attaching means.

5. A light guard as defined in claim 4 wherein at least one of said latch rods has a release tab thereon facilitating release of said one of said latch rods from its associated retaining flange whereby to facilitate detachment of said cage member from said shield member.

6. A light guard as defined in claim 4 wherein said retaining flanges extend longitudinally of the lateral edges of said shield member and each has an inclined ramp surface formed thereon, said latch rods being spaced laterally a distance sufficient to facilitate engagement of at least one of said latching rods with one of said ramp surfaces and biasing of said one of said latching rods outwardly and over the corresponding retaining flange as said cage member is attached to said shield member so that said one of said latch rods springs back to be retained by said corresponding retaining flange.

7. A light guard as defined in claim 6 wherein said retaining flanges have retaining ridges on their surfaces opposite said ramp surfaces to releasably retain said latch rods in cooperating relation with said retaining flanges when said cage member is attached to said shield member.

8. A light guard as defined in claim 6 wherein said retaining flanges define opposite end surfaces, said latch rods being disposed between stop surfaces spaced so as to cooperate with said end surfaces on said retaining flanges to limit relative longitudinal movement between said shield and cage members.

9. A light guard as defined in claim 8 wherein said shield and cage members further include detent means cooperable to fixedly locate and prevent shifting of said cage on said shield member when attached thereto.

10. A light guard as defined in claim 4 wherein said shield and cage members are made of a plastic material comprising a thermoset or thermoplastic polyester.

11. A light guard as defined in claim 1 including a hook formed on said shield member to facilitate hanging of said light guard.

* * * * *